US010370894B2

(12) United States Patent
Kuster et al.

(10) Patent No.: US 10,370,894 B2
(45) Date of Patent: Aug. 6, 2019

(54) METHOD AND DEVICE FOR PRODUCING A TRIPLE INSULATING GLAZING UNIT

(71) Applicant: SAINT-GOBAIN GLASS FRANCE, Courbevoie (FR)

(72) Inventors: Hans-Werner Kuster, Aachen (DE); Walter Schreiber, Aachen (DE)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 0 days.

(21) Appl. No.: 15/555,053

(22) PCT Filed: Apr. 21, 2016

(86) PCT No.: PCT/EP2016/058940

§ 371 (c)(1),
(2) Date: Aug. 31, 2017

(87) PCT Pub. No.: WO2016/170079

PCT Pub. Date: Oct. 27, 2016

(65) Prior Publication Data

US 2018/0038150 A1 Feb. 8, 2018

(30) Foreign Application Priority Data

Apr. 22, 2015 (EP) ..... 15164591

(51) Int. Cl.
*E06B 3/67* (2006.01)
*E06B 3/663* (2006.01)
(Continued)

(52) U.S. Cl.
CPC ..... *E06B 3/66366* (2013.01); *E06B 3/663* (2013.01); *E06B 3/66304* (2013.01);
(Continued)

(58) Field of Classification Search
CPC .. E06B 3/66366; E06B 3/663; E06B 3/66304; E06B 3/66319; E06B 3/66347
See application file for complete search history.

(56) References Cited

U.S. PATENT DOCUMENTS 3,875,706 A 4/1975 Okawa et al.
5,350,469 A 9/1994 Lenhardt et al.
(Continued)

FOREIGN PATENT DOCUMENTS

CA 2275448 A1 7/1998
CN 1556680 A 12/2004
(Continued)

OTHER PUBLICATIONS

International Search Report issued for International Application No. PCT/EP2016/058940, filed Apr. 21, 2016 on behalf of Saint-Gobain Glass France, dated Jul. 22, 2016. 4 pages.
(Continued)

*Primary Examiner* — Paola Agudelo
(74) *Attorney, Agent, or Firm* — Steinfl+Bruno, LLP

(57) ABSTRACT

A method for producing a triple insulating glazing unit is presented. According to the method, one pane is inserted into a groove of a spacer that is peripherally shaped to form a spacer frame to enframe the pane. A first pane and a second pane are connected to corresponding contact surfaces of the spacer frame by way of an upper edge and lateral edges of the first and second panes. Lower edges of the first and second panes are bent outward. Formed interpane spaces are filled from below with a protective gas, and the arrangement of the panes and the spacer frame is sealed and pressed together.

13 Claims, 10 Drawing Sheets

Figure 1:
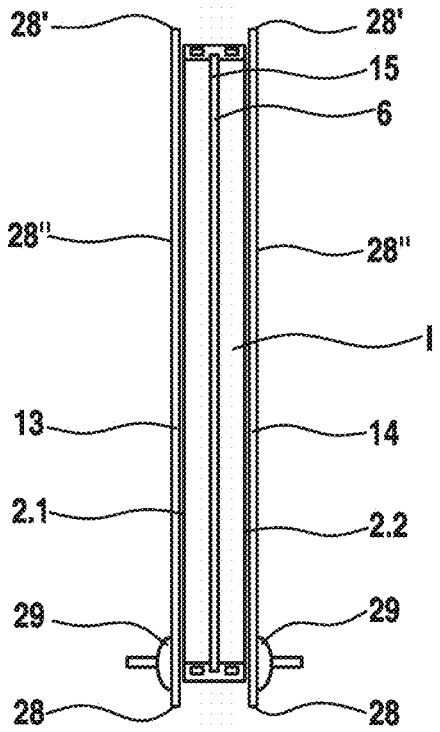

(51) Int. Cl.
*E06B 3/677* (2006.01)
*E06B 3/673* (2006.01)

(52) U.S. Cl.
CPC ..... *E06B 3/66319* (2013.01); *E06B 3/66347* (2013.01); *E06B 3/6775* (2013.01); *E06B 3/6715* (2013.01); *E06B 3/67313* (2013.01); *E06B 2003/6638* (2013.01); *E06B 2003/66395* (2013.01)

(56) References Cited

U.S. PATENT DOCUMENTS

| | | | | |
|---|---|---|---|---|
| 5,666,771 | A * | 9/1997 | Macquart | G02F 1/1523 359/260 |
| 7,858,193 | B2 | 12/2010 | Ihlo et al. | |
| 9,739,085 | B2 | 8/2017 | Kuster et al. | |
| 2002/0192473 | A1 | 12/2002 | Gentilhomme et al. | |
| 2004/0028953 | A1 | 2/2004 | Kraemling | |
| 2009/0186213 | A1 | 7/2009 | Ihlo et al. | |
| 2009/0197077 | A1 | 8/2009 | Reutler et al. | |
| 2012/0011722 | A1* | 1/2012 | Briese | E06B 3/67308 29/897.3 |
| 2012/0141699 | A1 | 6/2012 | Maeder | |
| 2012/0285605 | A1* | 11/2012 | Ripoche | E06B 3/6775 156/109 |
| 2013/0305656 | A1* | 11/2013 | Ripoche | E06B 3/66352 52/786.13 |
| 2013/0319598 | A1 | 12/2013 | Grommesh et al. | |
| 2014/0109499 | A1 | 4/2014 | Nieminen et al. | |
| 2014/0311065 | A1 | 10/2014 | Schreiber | |
| 2014/0345781 | A1* | 11/2014 | Ripoche | E06B 3/6675 156/109 |
| 2016/0120336 | A1* | 5/2016 | Schneider | A47F 3/0434 312/116 |
| 2016/0138326 | A1 | 5/2016 | Kuster et al. | |
| 2017/0321472 | A1 | 11/2017 | Frank et al. | |
| 2017/0321473 | A1 | 11/2017 | Frank et al. | |
| 2017/0328119 | A1 | 11/2017 | Kuster et al. | |
| 2018/0038150 | A1* | 2/2018 | Kuster | E06B 3/663 |

FOREIGN PATENT DOCUMENTS

| | | | |
|---|---|---|---|
| CN | 1916351 | A | 2/2007 |
| CN | 1990971 | A | 7/2007 |
| CN | 103109031 | A | 5/2013 |
| CN | 104011313 | A | 8/2014 |
| CN | 104213809 | A | 12/2014 |
| DE | 2835669 | A1 | 2/1980 |
| DE | 19829151 | C1 | 2/2000 |
| DE | 19927683 | C1 | 1/2001 |
| DE | 102009006062 | A1 | 7/2010 |
| DE | 102009057156 | A1 | 6/2011 |
| EP | 0852280 | A1 | 7/1998 |
| EP | 0912455 | B1 | 5/2006 |
| EP | 1218307 | B1 | 7/2008 |
| EP | 1917222 | B1 | 3/2009 |
| EP | 2733295 | A1 | 5/2014 |
| EP | 3020908 | A1 | 5/2016 |
| EP | 3286396 | A1 | 2/2018 |
| FR | 2253138 | A1 | 6/1975 |
| GB | 2198776 | A | 6/1988 |
| JP | S588292 | A | 1/1983 |
| JP | 2007277052 | A | 10/2007 |
| JP | 2008156217 | A | 7/2008 |
| JP | 2013532107 | A | 8/2013 |
| KR | 20140100573 | A | 8/2014 |
| WO | 2007/101964 | A1 | 9/2007 |
| WO | 2010115456 | A1 | 10/2010 |
| WO | 2011095732 | A2 | 8/2011 |
| WO | 2012141699 | A1 | 10/2012 |
| WO | 2013/114302 | A1 | 8/2013 |
| WO | 2014/157666 | A1 | 10/2014 |
| WO | 2014/198549 | A1 | 12/2014 |
| WO | 2014198429 | A1 | 12/2014 |
| WO | 2014198431 | A1 | 12/2014 |
| WO | 2016/068305 | A1 | 5/2016 |
| WO | 2016/091646 | A1 | 6/2016 |
| WO | 2016/091647 | A1 | 6/2016 |
| WO | 2016/091648 | A1 | 6/2016 |
| WO | 2016138326 | A1 | 9/2016 |
| WO | 2016170079 | A1 | 10/2016 |

OTHER PUBLICATIONS

Written Opinion for International Application PCT/EP2016/058940 filed Apr. 21, 2016 on behalf of Saint-Gobain Glass France, dated Jul. 22, 2016. 11 pages. (English translation + German original).

1st Office Action for Chinese Patent Application No. 201680023147.X, filed on Apr. 21, 2016, on behalf of Saint-Gobain Glass France, dated Sep. 19, 2018. 10 pages.

Huntsman International, "A guide to thermoplastic polyurethanes (TPU)", pp. 1-26, (Dec. 31, 2010). Retrieved Oct. 26, 2018 from http://www.huntsman.com/polyurethanes/Media%20Library/global/files/guide_tpu.pdf.

International Preliminary Report on Patentability for International Application No. PCT/EP2015/078141 filed on Dec. 1, 2015 on behalf of Saint-Gobain Glass France dated Jun. 13, 2017. 11 pages (English + Original).

International Preliminary Report on Patentability for International Application No. PCT/EP2015/078145 filed on Jan. 12, 2015 on behalf of Saint-Gobain Glass France dated Jun. 13, 2017. 11 pages (English + Original).

International Preliminary Report on Patentability for International Application No. PCT/EP2016/058940 filed on Apr. 21, 2016 on behalf of Saint-Gobain Glass France dated Oct. 24, 2017. 13 pages (English + Original).

International Preliminary Report on Patentability for International Application No. PCT/EP2017/069947 filed on Aug. 7, 2017on behalf of Saint-Gobain Glass France dated Mar. 19, 2019. 17 pages (English + Original).

International Search Report for International Application No. PCT/EP2017/069947 filed Aug. 7, 2017 on behalf of Saint-Gobain Glass France, dated Oct. 6, 2017. 6 pages (English Translation + German Original).

International Search Report for International Application No. PCT/EP2015/078141 filed on Dec. 1, 2015 on behalf Saint-Gobain Glass France dated Jan. 22, 2016. 5 pages (English + Original).

International Search Report for International Application No. PCT/EP2015/078144 filed on Dec. 1, 2015 on behalf of Saint-Gobain Glass France dated Feb. 9, 2016. 5 pages (English + Original).

International Search Report for International Application No. PCT/EP2015/078145 filed on Jan. 12, 2015 on behalf of Saint-Gobain Glass France dated Mar. 14, 2016. 5 pages (English + Original).

Non-Final Office Action for U.S. Appl. No. 15/531,703, filed May 30, 2017 on behalf of Saint-Gobain Glass France, dated Feb. 21, 2019. 13 pages.

Non-Final Office Action for U.S. Appl. No. 15/531,730, filed May 30, 2017, on behalf of Saint-Gobain Glass France, dated Jan. 7, 2019. 15 pages.

Non-Final Office Action for U.S. Appl. No. 15/531,728, filed May 30, 2017 on behalf of Saint-Gobain Glass France, dated Feb. 21, 2019. 14 pages.

Office Action for Canadian Patent Application No. 2,980,680 filed Sep. 22, 2017 on behalf of Saint-Gobain Glass France, dated Aug. 17, 2018. 4 pages.

Search Report for Chinese Patent Application No. 201680023147.X, filed on Apr. 21, 2016, on behalf of Saint-Gobain Glass France, dated Sep. 19, 2018. 2 pages.

International Preliminary Report on Patentability for International Application No. PCT/EP2015/078144 filed on Dec. 1, 2015 on behalf of Saint-Gobain Glass France dated Jun. 13, 2017. 11 pages (English + Original).

Written Opinion for International Application No. PCT/EP2015/078144 filed on Dec. 1, 2015 on behalf of Saint-Gobain Glass France dated Feb. 9, 2016. 9 pages (English + Original).

Written Opinion for International Application No. PCT/EP2015/078145 filed on Jan. 12, 2015 on behalf of Saint-Gobain Glass

(56) References Cited

OTHER PUBLICATIONS

France dated Mar. 14, 2016. 9 pages (English + Original).
Written Opinion for International Application No. PCT/EP2017/069947 filed on Aug. 7, 2017 on behalf of Saint-Gobain Glass France, dated Oct. 6, 2017. 15 pages (English Translation + German Original).
Written Opinion for International Application No. PCT/EP2015/078141 filed on Dec. 1, 2015 on behalf Saint-Gobain Glass France dated Jan. 22, 2016. 9 pages (English + Original).

* cited by examiner

METHOD AND DEVICE FOR PRODUCING A TRIPLE INSULATING GLAZING UNIT

CROSS-REFERENCE TO RELATED APPLICATIONS

The present application is the U.S. National Stage of International Patent Application No. PCT/EP2016/058940 filed on Apr. 21, 2016 which, in turn, claims priority to European Patent Application No. 15164591.8 filed on Apr. 22, 2015.

The present invention relates to a method for producing a triple insulating glazing unit, a device for the method according to the invention, a triple insulating glazing unit produced by the method according to the invention, and use thereof.

The thermal conductivity of glass is lower by roughly a factor of 2 to 3 than that of concrete or similar building materials. However, since, in most cases, panes are designed significantly thinner than comparable elements made of brick or concrete, buildings frequently lose the greatest share of heat via external glazing. The increased costs necessary for heating and air-conditioning systems make up a part of the maintenance costs of the building that must not be underestimated. Moreover, as a consequence of more stringent construction regulations, lower carbon dioxide emissions are required. Triple insulating glazing units, without which, primarily as a result of increasingly rapidly rising prices of raw materials and more stringent environmental protection constraints, it is no longer possible to imagine the building construction sector, are an important approach to a solution for this. Consequently, triple insulating glazing units constitute an increasingly greater part of outward directed glazing units.

Triple insulating glazing units usually include three panes made of glass or polymeric materials that are separated from one another by two individual spacers. A further pane is placed on a double glazing unit using an additional spacer. During assembly of such a triple glazing unit, very small tolerance specifications apply since the two spacers must be installed at exactly the same height. Thus, compared to double glazing units, the assembly of triple glazing units is significantly more complex since either additional system components must be provided for the assembly of another pane or a time-consuming multiple pass through a conventional system is necessary EP 0 852 280 A1 discloses a spacer for double insulating glazing units. The spacer includes a metal foil on the adhesion surface and glass fiber content in the plastic of the main body. Such spacers are also frequently used in triple insulating glazing units, wherein a first spacer is mounted between a first outer pane and the inner pane, and a second spacer is mounted between a second outer pane and the inner pane. Here, the two spacers must be installed congruently to ensure a visually appealing appearance.

WO 2010/115456 A1 discloses a hollow profile spacer with a plurality of hollow chambers for multiple glass panes comprising two outer panes and one or a plurality of middle panes that are installed in a groove-shaped accommodating profile. Here, the spacer can be manufactured both from polymeric materials as well as being made of rigid materials, such as stainless steel or aluminum. The middle glass of the multiple glass panes is preferably fixed with a primary seal, in particular an adhesive based on butyl, acrylate, or hotmelt. By means of the fixing with the primary seal, an exchange of air between the interpane spaces of the multiple glass pane is prevented.

DE 10 2009 057 156 A1 describes a triple insulating glazing unit that includes a shear-resistant spacer that is bonded in a shear-resistant manner to two outer panes with a high-tensile adhesive. The spacer has a groove in which the middle pane of the triple insulating glazing unit is fixed. The fixing is ensured, for example, by a butyl seal in the groove. The two interpane spaces are hermetically sealed from one another.

The spacers described in WO 2010/115456 A1 and in DE 10 2009 057 156 A1, which can accommodate a third pane in a groove, have the advantage that only a single spacer has to be installed and, thus, the step of the alignment of two individual spacers in the prior art triple glazing unit is eliminated. Both documents describe the fixing of the middle pane using a seal such that an exchange of air between the inner interpane spaces is prevented and the two interpane spaces are hermetically sealed from one another. This has the disadvantage that no pressure equalization between the individual interpane spaces can occur. With temperature differences between the interpane space turned toward the building interior and the interpane space turned toward the building exterior, pressure differences arise between the two interpane spaces. When the interpane spaces are hermetically sealed, no equalization can occur, as a result of which there is a high load on the middle pane. In order to increase the stability of the middle pane, thicker and/or prestressed panes must be used. This results in increased material and production costs.

From WO 2014/198429 A1 and WO 2014/198431, insulating glazing units and methods for producing triple insulating glazing units are known. According to the known method for producing a triple insulating glazing unit, the inner or third pane is inserted into the groove of the spacer, then, the first pane is installed on the first pane contact surface and the second pane is installed on the second pane contact surface of the spacer, and, thereafter, the pane arrangement comprising the panes and the spacer is pressed together.

In the production of triple insulating glazing units, there is the need to increase productivity. With the conventional methods, it is already possible to produce triple insulating glazing units with tension-free fixing of the middle pane. The disadvantage with the conventional methods consists in the time-consuming connecting of the three individual panes.

One object of the present invention is to provide an economical and environmentally friendly method for producing a triple insulating glazing unit with tension-free fixing of the middle pane.

The object of the present invention is accomplished according to the invention by a method for producing a triple insulating glazing unit according to the independent claims. Preferred embodiments of the invention are apparent from the subclaims.

The object of the present invention is accomplished according to the invention by a method for producing a triple insulating glazing unit, wherein at least a) one pane is inserted into the groove of a spacer, and the spacer is shaped peripherally to form a spacer frame, which enframes the pane, and the spacer frame with the middle pane is set between a first outer pane and a second outer pane, b) the first pane is connected to the first pane contact surface of the spacer frame and the second pane is connected to the second pane contact surface of the spacer frame by the upper edge and the lateral edges, and the lower edges of the first outer pane and the second outer pane are bent outward, c) the interpane spaces are filled from below with protective gas, and d) the pane arrangement comprising the panes and the spacer frame is sealed and pressed together.

By means of the method according to the invention for producing a triple insulating glazing unit, the prefabricated spacer frame with a pre-mounted inner pane is advantageously connected to the outer panes. Consequently, a module comprising a spacer and an inner or third pane is manufactured.

The spacer and the inner pane are connected to the first and second outer pane. In this step, the triple insulating pane is simultaneously filled with protective gas. The insulating glazing unit is filled with a protective gas, preferably with a noble gas, preferably argon or krypton, which reduce the heat transfer value in the insulating glazing interpane space.

The device for the inventive method provides a double press in which the outer panes are positioned and with which the panes are partially bent in order to enable the gas filling. At the same time, the previously prepared protective gas is introduced. The triple insulating glazing unit it is also simultaneously pressed.

Due to the reduction in the cycle time of production, the method according to the invention for producing a triple insulating glazing unit is significantly more economical.

A preferred embodiment of the invention is a method for producing a triple insulating glazing unit, wherein the following steps occur simultaneously in which the edges of the first pane and of the second pane are bent outward, and in which the interpane spaces are filled from below with protective gas.

A preferred embodiment of the invention is a method for producing a triple insulating glazing unit, wherein the edges of the outer panes, i.e., of the first pane and of the second pane, are bent outward and then the module, i.e., the arrangement comprising a spacer frame and the middle pane, is set between the first pane and the second pane. This method represents an alternative according to the invention.

The two method variants are within the scope of the invention. To carry out the method according to the invention, it is essential to perform multiple method steps synchronously in order to accelerate the entire method and to increase cycle times, so that the average time in which one unit leaves the production system is reduced.

A preferred embodiment of the invention is a method for producing a triple insulating glazing unit, wherein the lower edge is bent outward 2 mm to 10 mm. Good results are obtained with bending in this range.

A preferred embodiment of the invention is a method for producing a triple insulating glazing unit, wherein the lower edge is bent outward 4 mm to 6 mm. Very good results are obtained with bending in this range.

A preferred embodiment of the invention is a method for producing a triple insulating glazing unit, wherein the lower edge is bent outward with a suction device. The suction device is a gentle and effective device for the bending.

A preferred embodiment of the invention is a method for producing a triple insulating glazing unit, wherein the interpane spaces are filled with protective gas from below through the gap formed by bending the edge. In this manner, the interpane spaces can be filled with protective gas very quickly and effectively.

A preferred embodiment of the invention is a method for producing a triple insulating glazing unit, wherein the interpane spaces are filled with noble gas, preferably argon, krypton, or mixtures thereof. The heat transfer value in the interpane space of the insulating glazing unit is advantageously reduced by the noble gases. These noble gases are particularly well-suited for filling the interpane spaces due to their high specific gravity.

The object of the present invention is further accomplished according to the invention by a device for carrying out the method for producing a triple insulating glazing unit, comprising a rack into which the spacer frame with the middle pane and the first pane and the second pane are inserted, a suction device with which the lower edges of the first pane and of the second pane are bent outward, a gas filling device by means of which the interpane spaces are filled with protective gas from below through the gap formed by bending the lower edge, and a pressing device with which the edges of the first pane and of the second pane are pressed peripherally against the first pane contact surface and against the second pane contact surface of the spacer frame.

With this double pressing device, the outer panes can be pressed on the upper edge and the lateral edges on the pane contact surface of the spacer frame, and the lower edges of the pane are initially bent outward for filling with protective gas and, then, after filling are also pressed against the pane contact surfaces of the spacer frame.

A preferred embodiment of the invention is a device for carrying out the method for producing a triple insulating glazing unit, wherein the suction device has at least two suction cups on the lower edge of the panes. With this device, the interpane spaces can be gently and efficiently filled with protective gas.

A preferred embodiment of the invention is a device for carrying out the method for producing a triple insulating glazing unit, wherein the gas filling device has its own additional spacer. With this device, the interpane spaces can be gently and efficiently filled with protective gas.

The object of the present invention is further accomplished by a triple insulating glazing unit, at least comprising a pane enframed by a spacer frame, wherein the pane is inserted into the groove of a spacer, and the spacer is shaped peripherally to form a spacer frame, a first pane is attached on the first pane contact surface of the spacer frame and a second pane is attached on the second pane contact surface of the spacer frame, the interpane spaces are filled from below with protective gas, the pane arrangement comprising the panes and the spacer frame is sealed and pressed together, and the outer region between the outer surface of the spacer frame and the outer edges of the panes contains outer insulation peripherally.

The triple insulating glazing unit according to the invention is preferably used in construction and architecture indoors and outdoors.

Figure 2:
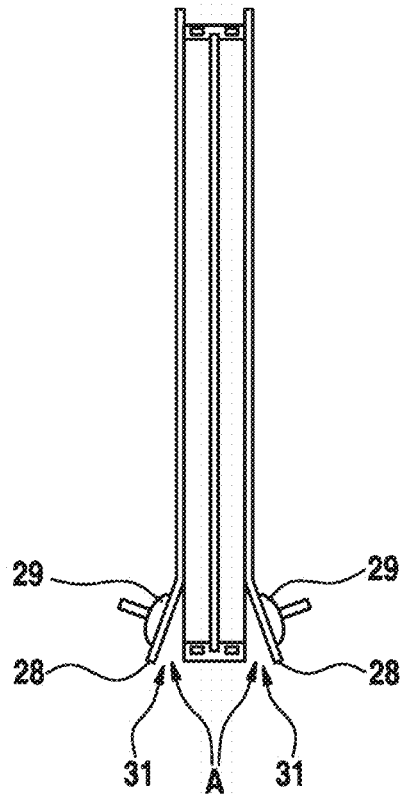
Figure 3:
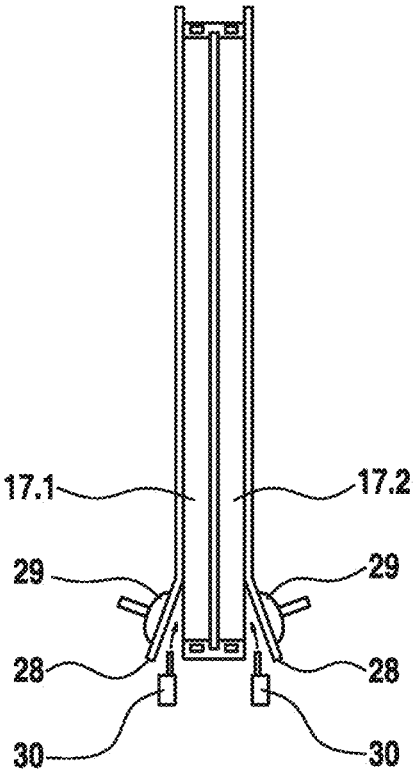
Figure 4:
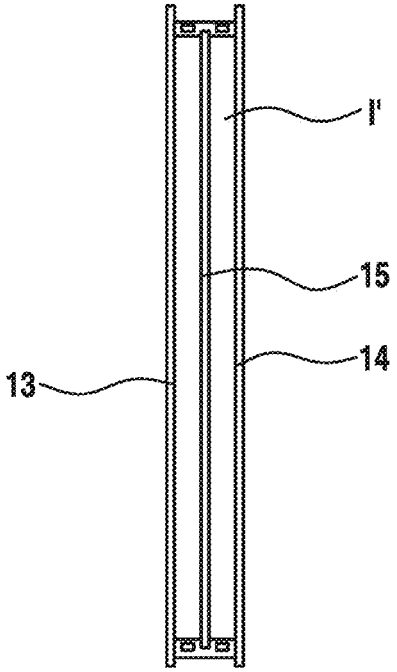
Figure 5:
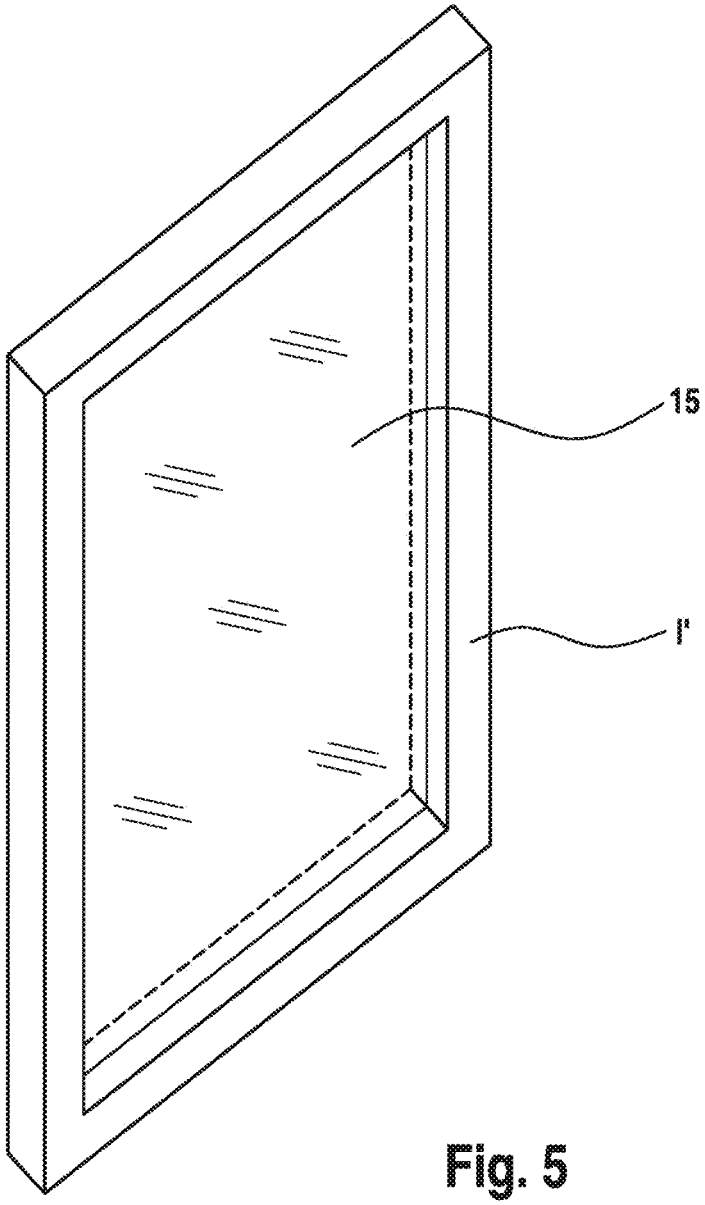
Figure 5B:
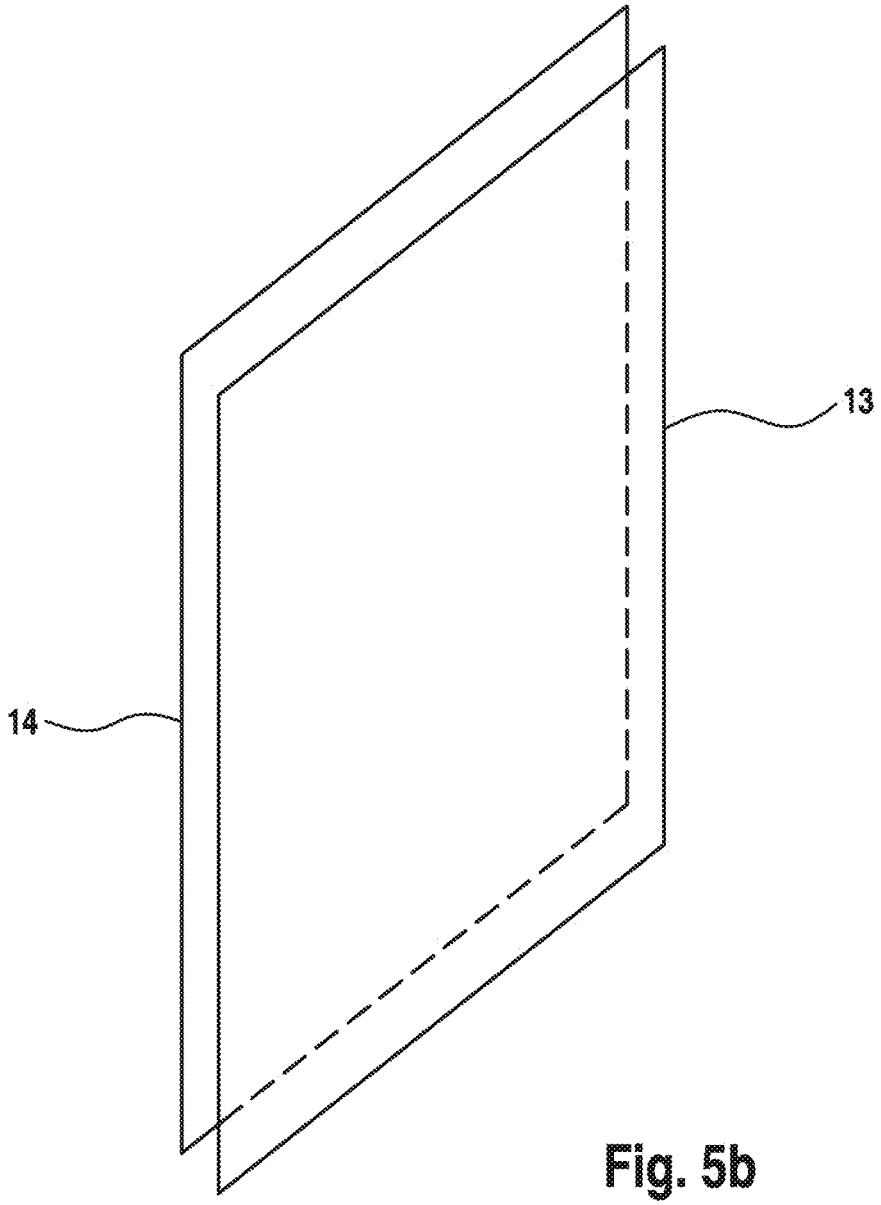
Figure 6:
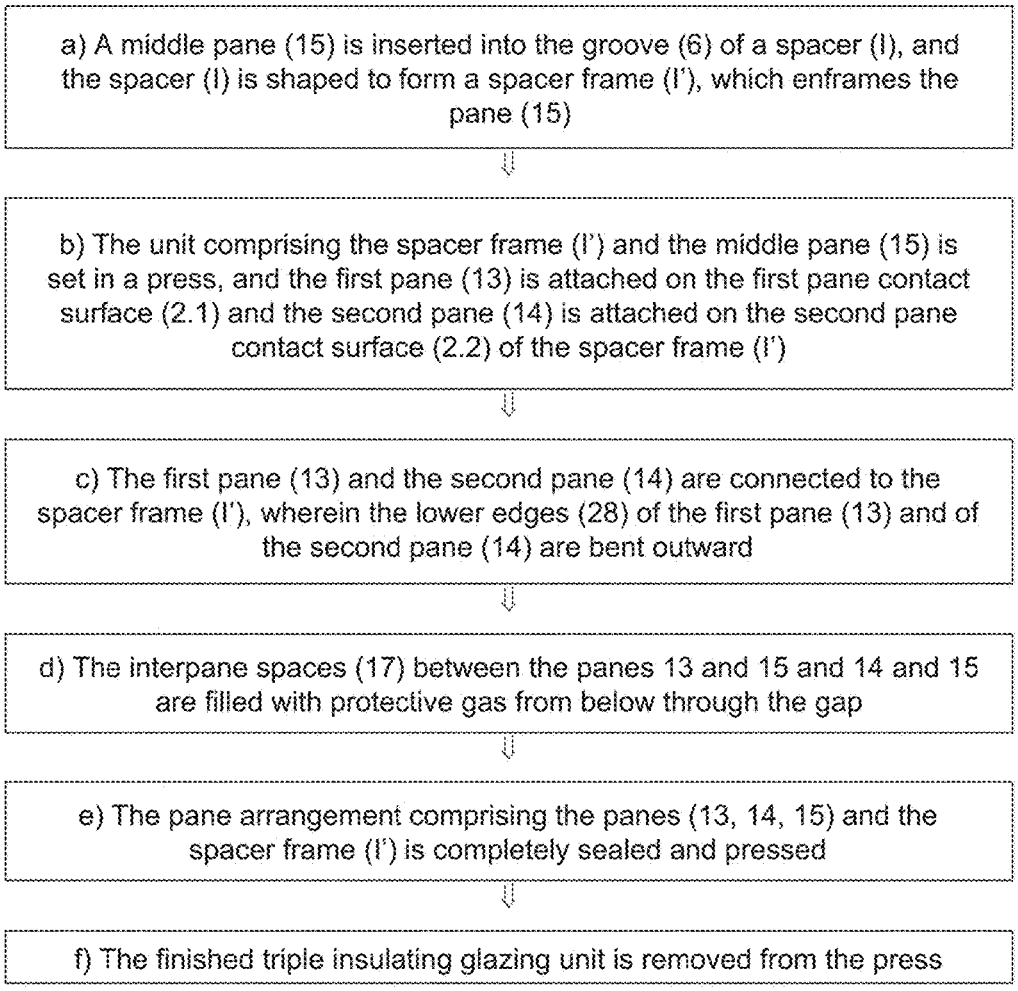
Figure 7:
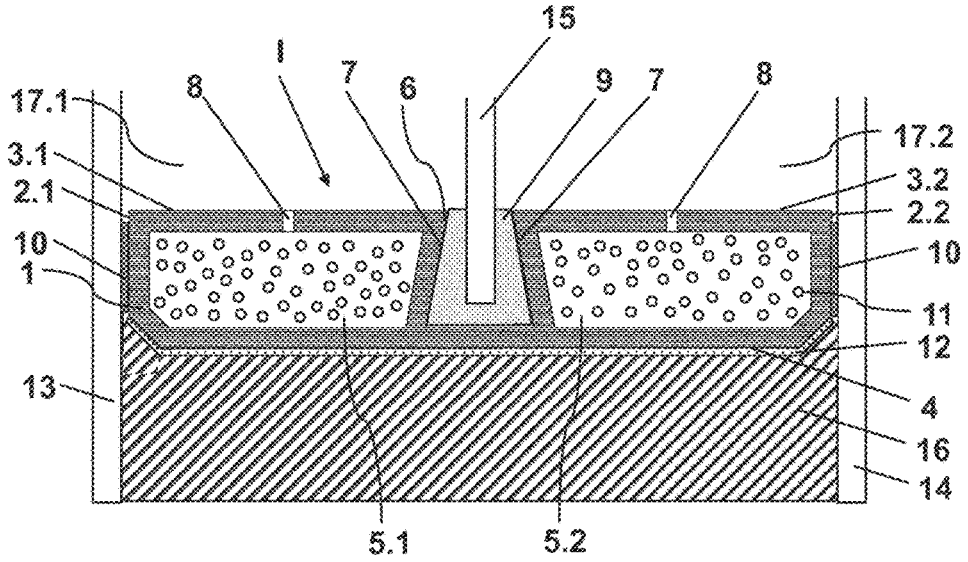
Figure 8:
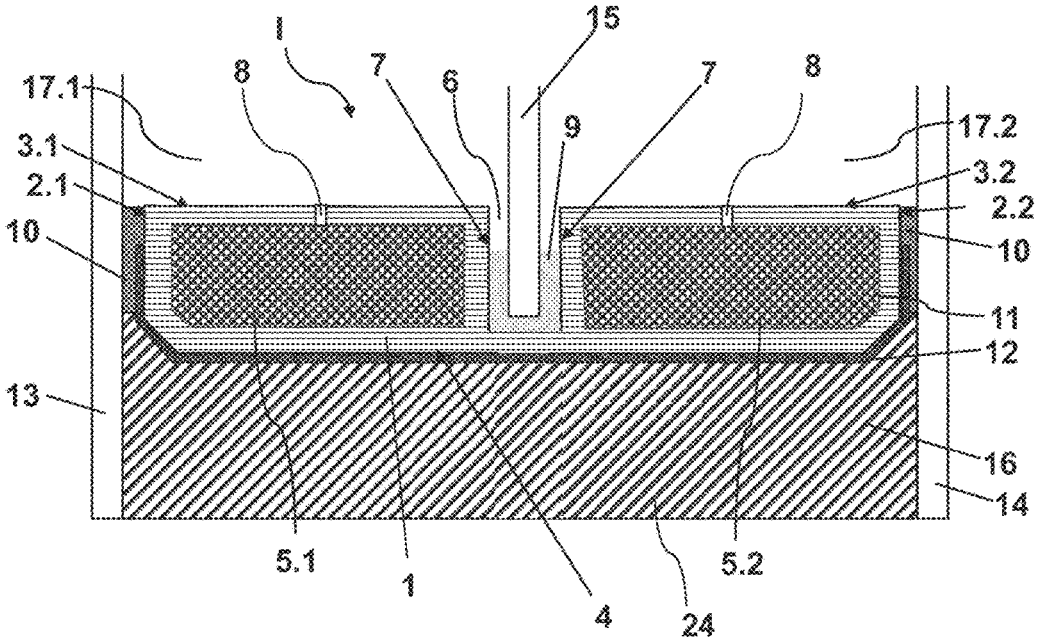
Figure 9:
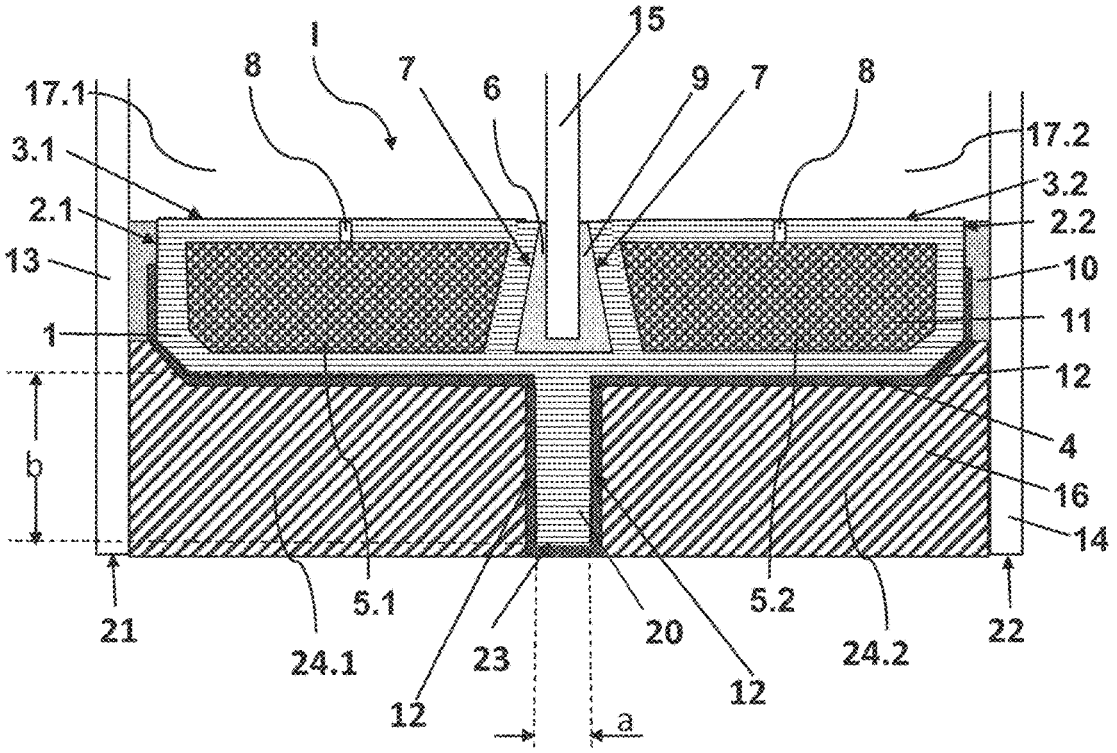
Figure 10:
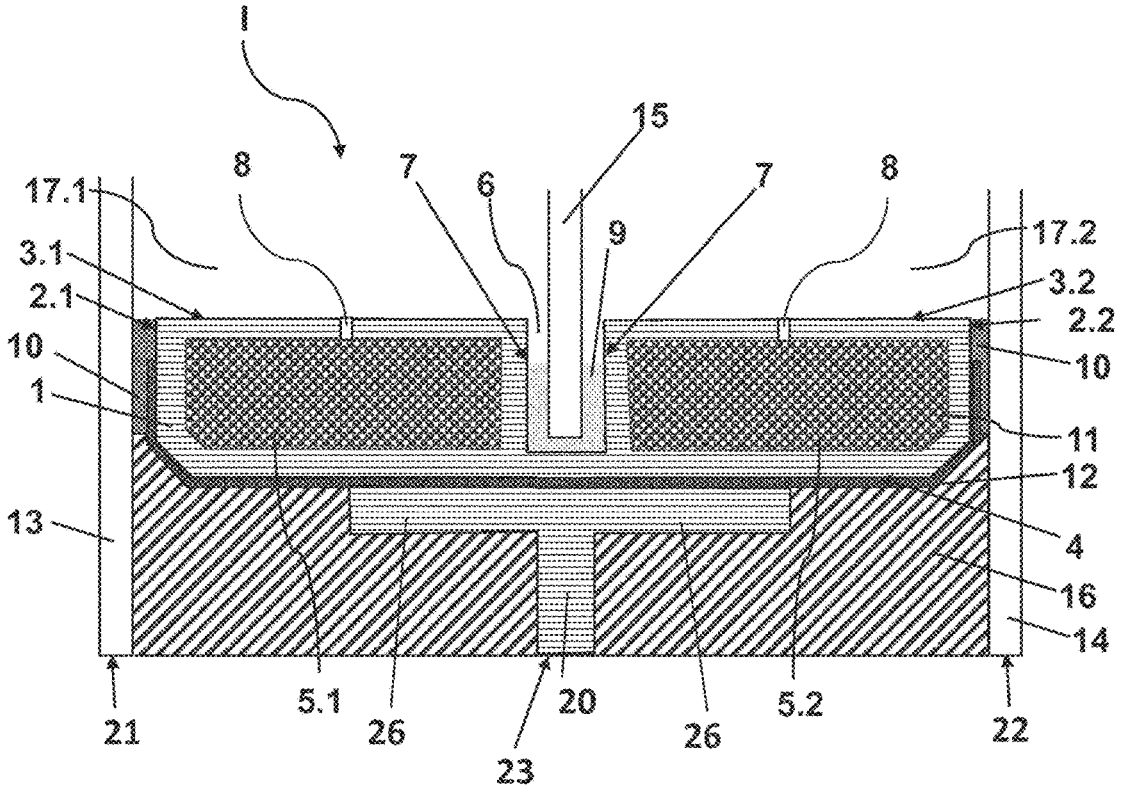
Figure 11:
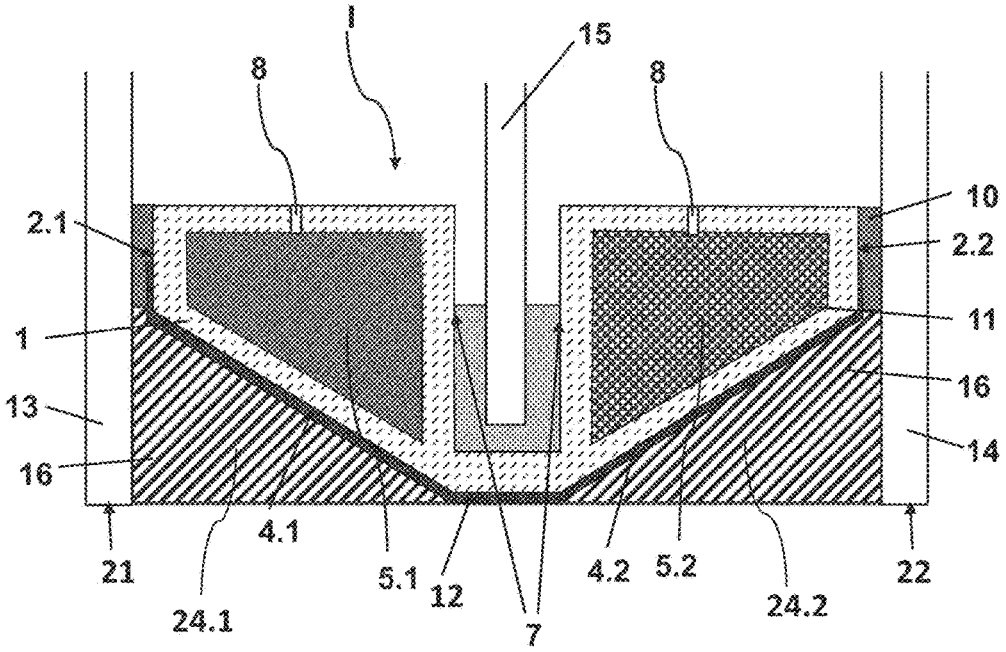

The invention is explained in detail in the following with reference to drawings and examples. The drawings are purely schematic representations and are not true to scale. They in no way restrict the invention. They depict:

FIG. 1 a cross-section of the insulating glazing unit according to the invention, schematically the first process step, FIG. 2 a cross-section of the insulating glazing unit according to the invention, schematically the second process step, FIG. 3 a cross-section of the insulating glazing unit according to the invention, schematically the third process step, FIG. 4 a cross-section of the insulating glazing unit according to the invention, schematically the fourth process step, FIG. 5 a plan view of a pane enframed by a spacer frame, FIG. 5*b* a plan view of a first and second pane, which are connected to the contact surfaces of the spacer frame, FIG. 6 a flowchart of a possible embodiment of the method according to the invention, FIG. 7 a cross-section of the insulating glazing unit according to the invention, FIG. 8 a cross-section of the insulating glazing unit according to the invention, FIG. 9 a cross-section of the insulating glazing unit according to the invention, FIG. 10 a cross-section of the insulating glazing unit according to the invention, and FIG. 11 a cross-section of the insulating glazing unit according to the invention.

FIG. 1 schematically depicts the first process step of the method according to the invention. A pane 15 is inserted in the groove 6 of a spacer I. The spacer I is shaped peripherally to form a spacer frame I', which enframes the pane 15. First pane 13 is connected to the first pane contact surface 2.1 of the spacer frame I' and second pane 14 is connected to the second pane contact surface 2.2 by the upper edge 28' and the lateral edges 28". The panes 13, 14 are pressed on the edges 28' and 28" against the spacer frame I'. FIG. 2 schematically depicts the second process step of the method according to the invention. In this process step, the lower edges 28 of the first pane 13 and of the second pane 14 are bent outward with a distance of 4 mm to 6 mm. FIG. 3 schematically depicts the third process step of the method according to the invention. In this process step, the interpane spaces 17.1 and 17.2 are filled with protective gas from below through the gap on the lower edge 28. FIG. 4 schematically depicts the fourth process step of the method according to the invention. In this process step, the panes 13 and 14 are entirely pressed against the contact surfaces 2.1 and 2.2 of the spacer frame I' on all four edges 28', 28" and 28. This creates the bonded fixed pane arrangement comprising the panes 13, 14, 15 and the spacer frame I'.

FIG. 5 depicts a perspective plan view of an inner pane 15 enframed by a spacer frame I'. This yields a module comprising the inner pane 15, which is anchored in the groove 6 of the spacer and is completely enframed by the spacer I to form a spacer frame I'.

FIG. 5*b* is a plan view of the first pane 13 and of the second pane 14, which are bonded to the contact surfaces 2.1 and 2.2 of the spacer frame I'.

FIG. 6 depicts a flowchart of a possible embodiment of the method according to the invention.

FIG. 7 depicts a cross-section of the insulating glazing unit with a spacer (I) according to the invention. The first pane (13) of the triple insulating glazing unit is connected via a seal (10) to the first pane contact surface (2.1) of the spacer (I), while the second pane (14) is connected via a seal (10) to the second pane contact surface (2.2). The seal (10) is made of butyl rubber. A third pane (15) is inserted into the groove (6) of the spacer via an insert (9). The insert (9) surrounds the edge of the third pane (15) and fits flush into the groove (6). The insert (9) is made of ethylene propylene diene rubber. The insert (9) fixes the third pane (15) without tension and compensates thermal expansion of the pane. Furthermore, the insert (9) prevents development of noise due to slippage of the third pane (15). The intermediate space between the first pane (13) and the third pane (15) is defined as the first interpane space (17.1) and the space between the third pane (15) and the second pane (14) is defined as the second interpane space (17.2). The first glazing interior surface (3.1) of the spacer (I) lies inside the first interpane space (17.1), while the second glazing interior surface (3.2) is arranged in the second interpane space (17.2). The interpane spaces (17.1, 17.2) are connected via the openings (8) in the glazing interior surfaces (3.1, 3.2) to the respective underlying hollow chamber (5.1, 5.2). A desiccant (11), consisting of molecular sieve, is situated in the hollow chambers. A gas exchange between the hollow chambers (5.1, 5.2) and the interpane spaces (17.1, 17.2) takes place through the openings (8), by which means the desiccant (11) extracts the atmospheric moisture from the interpane spaces (17.1, 17.2). An insulating film (12), which reduces the heat transfer through the polymeric main body (1) into the interpane spaces (17), is applied on the outer surface (4) of the spacer (I). The insulating film (12) can, for example, be affixed on the polymeric main body (1) with polyurethane hot melt adhesive. The insulating film (12) comprises four layers made of polyethylene terephthalate with a thickness of 12 μm and three metallic layers made of aluminum with a thickness of 50 nm. The metallic layers and the polymeric layers are alternatingly applied in each case, with the two outer layers being formed by polymeric layers. The first pane (13) and the second pane (14) protrude beyond the spacer (I) such that a peripheral edge region is created, which is filled with outer insulation (16). This outer insulation (16) is formed from an organic polysulfide. The first pane (13) and the second pane (14) are made of soda lime glass with a thickness of 3 mm, while the third pane (15) is formed from soda lime glass with a thickness of 2 mm.

FIG. 8 depicts a cross-section of an insulating glazing unit according to the invention with a spacer I according to the invention. The intermediate space between the pane 13 and the third pane 15 bounded by the first glazing interior surface 3.1 is defined here as the first inner interpane space 17.1, and the space between the third pane 15 and the second pane 14 bounded by the second glazing interior surface 3.2 is defined as the second inner interpane space 17.2. The inner interpane spaces 17.1 and 17.2 are connected to the respective underlying hollow chamber 5.1 or 5.2 via the openings 8 in the glazing interior surfaces 3.1 and 3.2. A desiccant 11, consisting of molecular sieve, is situated in the hollow chambers 5.1 and 5.2. A gas exchange between the hollow chambers 5.1, 5.2 and the interpane spaces 17.1, 17.2 takes place through the openings 8, by which means the desiccant 11 extracts the atmospheric moisture from the interpane spaces 17.1 and 17.2. The first pane 13 of the triple insulating glazing unit is connected via a seal 10 to the first pane contact surface 2.1 of the spacer I, while the second pane 14 is connected via a seal 10 to the second pane contact surface 2.2. The seal 10 is made of a cross-linking polyisobutylene. A third pane 15 is inserted into the groove 6 of the spacer via an insert 9. The insert 9 surrounds the edge of the third pane 15 and fits flush into the groove 6. The insert 9 is made of butyl rubber. The insert 9 fixes the third pane 15 without tension and compensates thermal expansion of the pane. Furthermore, the insert 9 prevents development of noise due to slippage of the third pane 15. A plurality of inserts 9 are mounted with intermediate spaces in the groove 6 such that a gas exchange and, hence, pressure equalization can take place between the two inner interpane spaces 17.1, 17.2. In this case, the side flanks 7 of the groove 6 run parallel to the pane contact surfaces 2.1 and 2.2. The insert 9 extends over the entire width of the floor of the groove but covers the side flanks 7 of the groove 6 only partially, thus saving material. The polymeric main body 1 is made of styrene acrylonitrile (SAN) with roughly 35% glass fiber. A barrier 12, which reduces the heat transfer through the polymeric main body 1 into the interpane spaces 17, is applied on the outer surface 4 and a part of the pane contact surfaces 2.1, 2.2. The barrier 12 is implemented as a barrier film 12 and can be affixed on the polymeric main body 1, for example, with a polyurethane hot melt adhesive. The barrier film 12 comprises four polymeric layers made of polyethylene terephthalate with a thickness of 12 μm and three metallic layers made of aluminum with a thickness of 50 nm. The metallic layers and the polymeric layers are alternatingly applied in each case, with the two outer layers being formed by polymeric layers. The first pane 13 and the second pane 14 protrude beyond the pane contact surfaces 2.1 and 2.2 such that an outer interpane space 24 is created, which is filled with an outer seal 16. The first pane 13 and the second pane 14 are made of soda lime glass with a thickness of 3 mm, while the third pane 15 is formed from soda lime glass with a thickness of 2 mm.

FIG. 9 depicts a cross-section of another insulating glazing unit according to the invention with a spacer I according to the invention. The insulating glazing unit corresponds essentially to the insulating glazing unit depicted in FIG. 8. The side flanks 7 of the groove 6 are inclined inward in the direction of the third pane 15. A web 20 is mounted below the groove 6. The web 20 serves, among other things, during the insulating glazing unit production, to stabilize the spacer with the integrated third pane. The height b of the web is 4.5 mm and the width a of the web is 3 mm. The polymeric main body 1 and the web 20 are implemented in one piece. This creates a particularly stable connection between the web 20 and the polymeric main body 1. The web 20 divides the outer interpane space into a first outer interpane space 24.1 and a second outer interpane space 24.2. The transverse surface of the first pane 21, the transverse surface of the second pane 22, and the edge of the web 23 are arranged at one height. The outer interpane spaces 24.1 and 24.2 are filled with an organic polysulfide 16. The web 20 divides the outer seal 16 into two parts. Since the thermal conductivity of the outer seal 16 is higher than that of the web 20, thermal decoupling occurs, which results in an improvement of the thermal insulation properties of the edge bond. A gas- and watertight barrier 12 is applied on the outer surface 4, which, with this one piece embodiment of the main body 1 and the web 20, also includes the lateral surfaces 25 and the edge 23 of the web.

FIG. 10 depicts a cross-section of an insulating glazing unit according to the invention with a spacer I according to the invention. The insulating glazing unit corresponds essentially to the insulating glazing unit depicted in FIG. 8. The web 20 and the polymeric main body 1 are implemented in two pieces. The web 20 is configured as a T-shaped profile. The two side arms 26 of the web 20 increase the stability of the spacer I, since the bonding area with the gas- and vapor-tight barrier 12 is enlarged. The thickness of the side arms is roughly 1 mm. The side arms cover only a part of the outer surface.

FIG. 11 depicts a cross-section of an insulating glazing unit according to the invention. The first pane 13 of the triple insulating glazing unit is connected via a seal 10 to the first pane contact surface 2.1 of the spacer I, while the second pane 14 is connected via a seal 10 to the second pane contact surface 2.2. The seal 10 is made of a polyisobutylene. The insert 9 surrounds the edge of the third pane 15 and fits flush into the groove 6. The insert 9 is made of butyl rubber and covers the floor 26 and a portion of the side flanks 7. The insert 9 fixes the third pane 15 without tension and compensates thermal expansion of the pane. Furthermore, the insert 9 prevents development of noise due to slippage of the third pane 15. The insert 9 is mounted such that a gas exchange is possible between the two inner interpane spaces 17.1, 17.2. For this, the insert 9 is not mounted continuously along the entire spacer profile but is divided into a plurality of parts. At those locations where no insert 9 is attached, a gas exchange and, hence, a pressure equalization can take place between the inner interpane spaces 17.1 and 17.2. Via the openings 8 in the glazing interior surfaces 3.1 and 3.2, the inner interpane spaces 17.1 and 17.2 are connected to the respective underlying hollow chamber 5.1 or 5.2. A desiccant 11, consisting of molecular sieve, is situated in the hollow chambers 5.1 and 5.2. A gas exchange between the hollow chambers 5.1, 5.2 and the inner interpane spaces 17.1 and 17.2 takes place through the openings 8, by which means the desiccant 11 extracts the atmospheric moisture from the inner interpane spaces 17.1 and 17.2. The first pane 13 and the second pane 14 protrude beyond the pane contact surfaces 2.1 and 2.2. The transverse surface of the first pane 21, the surface of the second pane 22, and the support edge 23 are arranged at one height. An outer seal 16 is applied in the outer inner pane spaces 24.1, 24.2. This outer seal 16 is formed from an organic polysulfide. Since the outer seal 16 is adjacent the seal 10, the edge bond is additionally sealed. The barrier 12 adequately seals the spacer I even in the regions without outer seal 16. The thermal conductivity of the outer seal 16 is higher than that of the polymeric main body 1. The outer interpane spaces 24.1, 24.2 are completely filled with the outer seal 16. By this means, optimum mechanical stabilization of the edge bond is achieved. Compared to a prior art spacer, outer seal 16 is saved. The insulating glazing unit according to the invention has, due to the separated interpane spaces 24.1, 24.2, improved insulation properties compared to a prior art insulating glazing unit, since a thermal decoupling takes place as a result of the separation.

The geometry of the spacer I in the insulating glazing unit according to the invention results, moreover, in an improvement of the stabilization of the third pane 15 in the groove 6. The distance between glazing interior surfaces 3.1, 3.2 and the edges of the outer panes 13, 14 is defined by the subsequent window frame because the seal 10 and the seal 16 are to be covered by the window frame of the finished insulating glass window. In the insulating glazing unit according to the invention, this region is optimally used for stabilization of the third pane 15 in the groove 6, since the depth of the groove is maximized. In the prior art insulating glazing unit, a much smaller depth of the groove is obtained and thus poorer stabilization of the third pane 15.

Due to the geometry of the spacer I of the insulating glazing unit according to the invention, the volume of the hollow chambers 5.1, 5.2 is additionally enlarged compared to an insulating glazing unit. More desiccant 11 can be accommodated in the enlarged hollow chambers 5.1, 5.2, as a result of which the service life of the insulating glazing unit is increased. The first pane 13 and the second pane 14 are made of soda lime glass with a thickness of 3 mm, while the third pane 15 is formed from soda lime glass with a thickness of 2 mm.

The outer interpane spaces 24.1, 24.2 are completely filled with the outer seal 16. Thus, optimum mechanical stabilization of the edge bond is obtained. Compared to a prior art spacer, outer seal 16 is saved.

EXAMPLE

Ten triple insulating glazing units were produced with the dimensions 1000 mm×1000 mm. For this, in each case, a module comprising a spacer I and an inner pane 15 was produced. The pane 15 had a thickness of 2 mm and dimensions of 990 mm×990 mm. The spacer I' corresponded to the spacer I depicted in FIG. 1. The pane 15 was inserted into the groove 6, and the spacer I was shaped around the pane 15 to form a spacer frame I'. The ends of the spacer frame I' were welded together. The module was placed vertically in a rack that was simultaneously a double pressing device. The outer panes 13 and 14 with a thickness of 3 mm and dimensions of 1000 mm×1000 mm were positioned against the contact surfaces 2.1 and 2.2 of the spacer I. The panes 13 and 14 were pressed by the upper edge 28' and side edges 28" against the contact surfaces 2.1 and 2.2. Simultaneously, the lower edge 28 of the panes 13 and 14 was bent outward by 5 mm with two suction cups 29 in each case. At the same time, argon was blown into the intermediate spaces 17.1 and 17.2 through the gap formed. After filling was completed, the lower edge of the panes 13 and 14 was also pressed against the contact surfaces 2.1 and 2.2 of the spacer frame I'. The triple insulating glazing unit was then lifted out of the rack and, hence, out of the double pressing device.

The production operation lasted 20 seconds on average.

Comparative Example

Ten triple insulating glazing units were produced with the same dimensions as in the Example, with the following differences. Two separate spacers (prior art) were used. For this, first, the pane 13 and the pane 15 and the first spacer were fed into the press, filled with argon, and, then, pane 14 with a second spacer was fed into the press to the existing assembly and the second interpane space was also filled with argon. Then, the entire glass assembly was pressed. The triple insulating glazing unit was then lifted out of the rack and, hence, out of the double pressing device.

The production operation lasted 30 seconds on average.

The result was unexpected and surprising. With the method according to the invention, the pace was successfully increased by 33.3%.

LIST OF REFERENCE CHARACTERS

I spacer
I' spacer frame
1 polymeric main body
2 pane contact surfaces
2.1 first pane contact surface
2.2 second pane contact surface
3 glazing interior surfaces
3.1 first glazing interior surface
3.2 second glazing interior surface
4 outer surface
5 hollow chambers
5.1 first hollow chamber
5.2 second hollow chamber
6 groove
7 side flanks
8 openings
9 insert
10 seal
11 desiccant
12 insulating film
13 first pane
14 second pane
15 third inner pane
16 outer insulation
17 interpane spaces
17.1 first interpane space
17.2 second interpane space
20 web
21 transverse surface of the first pane
22 transverse surface of the second pane
23 edge of the web
24 outer interpane spaces
24.1 first outer interpane space
24.2 second outer interpane space
25 lateral surfaces of the web
26 floor of the groove
27 support edge
28 lower edge of the first pane 13 and second pane 14
28' upper edge of the first pane 13 and second pane 14
28" lateral edges of the first pane 13 and second pane 14
29 suction device
29' suction cups
30 gas filling device
31 gap
A distance between the spacer frame I' and the lower edge 28 in the outward bent state

The invention claimed is:

1. A method for producing a triple insulating glazing unit, the method comprising:

a) inserting a pane into a groove of a spacer that is peripherally shaped to form a spacer frame, the spacer frame enframing the pane, wherein the spacer frame with the pane are arranged between a first pane and a second pane, b) connecting the first pane to a first pane contact surface of the spacer frame and connecting the second pane to a second pane contact surface of the spacer frame via a respective upper edge and respective lateral edges of the first pane and the second pane, and bending outward a respective lower edge of the first pane and of the second pane, c) filling, from below, interpane spaces with protective gas, and d) sealing and pressing together, a pane arrangement comprising the pane, the spacer frame, the first pane, and the second pane.

2. The method for producing a triple insulating glazing unit according to claim 1, wherein step b), in which the respective lower edge of the first pane and of the second pane is bent outward, and step c), in which the interpane spaces are filled, from below, with protective gas, occur simultaneously.

3. The method for producing a triple insulating glazing unit according to claim 1, wherein first, the respective lower edge of the first pane and of the second pane is bent outward, and second, an arrangement comprising the spacer frame and the enframed pane is arranged between the first pane and the second pane.

4. The method for producing a triple insulating glazing unit according to claim 1, wherein the respective lower edge is bent outward 2 mm to 10 mm.

5. The method for producing a triple insulating glazing unit according to claim 1, wherein the respective lower edge is bent outward 4 mm to 6 mm.

6. The method for producing a triple insulating glazing unit according to claim 1, wherein the respective lower edge is bent outward with a suction device.

7. The method for producing a triple insulating glazing unit according to claim 1, wherein the interpane spaces are filled with protective gas, from below, through a gap formed by the bending outward of the respective lower edge of the first pane and of the second pane.

8. The method for producing a triple insulating glazing unit according to claim 1, wherein the interpane spaces are filled, from below, with noble gas.

9. The method for producing a triple insulating glazing unit according to claim 8, wherein the noble gas comprises one of: a) argon, b) krypton, and c) mixtures of a) and b).

10. The method for producing a triple insulating glazing unit according to claim 1, wherein after the sealing, and pressing together, of the pane arrangement, an outer insulation is filled peripherally in an outer region of the pane arrangement between an outer surface of the spacer frame and outer edges of the first and second panes.

11. A device configured to carry out the method for producing a triple insulating glazing unit according to claim 1, the device comprising:

a) a rack into which the spacer frame with the enframed pane, and the first pane and the second pane are inserted, b) a suction device configured to bend outward the respective lower edge of the first pane and of the second pane, c) a gas filling device configured to fill the interpane spaces with the protective gas from below through gaps formed by bending outward of the respective lower edge of the first pane and of the second pane, and d) a pressing device configured to press together the pane arrangement by peripherally pressing edges of the first pane and of the second pane respectively against a first pane contact surface and a second pane contact surface of the spacer frame.

12. The device according to claim 11, wherein the suction device has at least two suction cups.

13. A triple insulating glazing unit comprising:

a spacer that is peripherally shaped to form a spacer frame, a pane, enframed by the spacer frame, wherein the pane is inserted into a groove of the spacer, a first pane attached on a first pane contact surface of the spacer frame, and a second pane attached on a second pane contact surface of the spacer frame, wherein interpane spaces formed by the enframed pane, the first pane, and the second pane, are filled, from below, with a protective gas, wherein a pane arrangement comprising the enframed pane, the spacer frame, the first pane, and the second pane, is sealed and pressed together, and wherein an outer region of the pane arrangement between an outer surface of the spacer frame and outer edges of the first and second panes contains outer insulation filled peripherally and separated from the outer surface of the spacer via an insulating film applied to the outer surface.

* * * * *